US008232881B2

(12) United States Patent
Hertz

(10) Patent No.: US 8,232,881 B2
(45) Date of Patent: Jul. 31, 2012

(54) SYSTEM FOR DETECTING AN ACCIDENT

(75) Inventor: Cecilia Hertz, Stockholm (SE)

(73) Assignee: Umbilical Design AB, Stockholm (SE)

( * ) Notice: Subject to any disclaimer, the term of this patent is extended or adjusted under 35 U.S.C. 154(b) by 443 days.

(21) Appl. No.: 12/530,234

(22) PCT Filed: Mar. 7, 2008

(86) PCT No.: PCT/SE2008/000185
§ 371 (c)(1),
(2), (4) Date: Sep. 8, 2009

(87) PCT Pub. No.: WO2008/108711
PCT Pub. Date: Sep. 12, 2008

(65) Prior Publication Data

US 2010/0102970 A1 Apr. 29, 2010

(30) Foreign Application Priority Data

Mar. 7, 2007 (SE) ..... 0700561

(51) Int. Cl.
*G08B 23/00* (2006.01)

(52) U.S. Cl. ..... 340/573.1; 340/539.1; 340/539.12

(58) Field of Classification Search ..... 340/573.1
See application file for complete search history.

(56) References Cited

U.S. PATENT DOCUMENTS

| | | | | |
|---|---|---|---|---|
| 5,311,197 | A | 5/1994 | Sorden et al. | |
| 5,978,972 | A * | 11/1999 | Stewart et al. | 2/422 |
| 6,826,509 | B2 * | 11/2004 | Crisco et al. | 702/141 |
| 2002/0160723 | A1 | 10/2002 | Yagi | |
| 2003/0197608 | A1 * | 10/2003 | Rudhard et al. | 340/539.18 |
| 2006/0074338 | A1 * | 4/2006 | Greenwald et al. | 600/549 |

FOREIGN PATENT DOCUMENTS

| | | | |
|---|---|---|---|
| AU | 2006100990 | A4 | 1/2007 |
| WO | WO 2006/036567 | A1 | 4/2006 |

* cited by examiner

*Primary Examiner* — George Bugg
*Assistant Examiner* — Kerri McNally
(74) *Attorney, Agent, or Firm* — Dickstein Shapiro LLP

(57) ABSTRACT

A system integrated in a helmet or another headgear, for the registration of direct violence against the head/body that a wearer of the helmet is subjected to in connection with an accident, comprising at least one sensor (12) intended to detect movements, at least one sensor for measuring vital data, a unit (13) arranged to register and receive data from the sensor and calculate at least one parameter of the head movement, based on said calculations, the unit being arranged to identify when an accident has occurred and to store data a certain time before the accident and stop storing a certain time after the accident as well as to generate an alarm and transmit information related to the accident to a receiver. Furthermore, the system is arranged to recreate the course of events based on registered, stored and processed data in order to provide as correct a picture of the accident as possible, and to monitor how vital data are developing after the accident so that the ill-fated thereby should get as quick and correct care as possible.

7 Claims, 2 Drawing Sheets

SYSTEM FOR DETECTING AN ACCIDENT

TECHNICAL FIELD

The present invention relates to a system for the detection body movements which indicate direct violence to the head and/or body of a person/individual in connection with an accident and change of vital data due to an accident, and more precisely to a system according to the preamble of claim 1.

By detecting the direct violence that arises in connection with an accident, information for automatic calling for nursing staff for an emergency medical effort can be generated when an accident has occurred, and thereby make the medical effort as quick, good and cost-effective as possible. By detecting change of vital data, the medical effort can be further improved qualitatively.

Particularly, the invention relates to fields of application where a helmet of some type is used, alternatively activities where violence against the body is usually occurring, for instance, during motorcycle-driving, cycling, skiing, riding, skydiving, mountain climbing, car-driving, etc.

BACKGROUND ART

Motorcycle drivers are an exposed group in the traffic. This shows, among others, statistics from the Swedish National Road Administration, which establish that during the period of, e.g., 2000-2004, 220 motorcycle drivers were killed in the Swedish traffic. Almost half of those were killed because of skull injuries, in spite of the fact that 77% of the victims used a helmet in a proper way. When consider the whole of Europe, the number of fatal accidents amounts to approx. 4000 annually.

In accidents, the motorcycle driver often becomes so badly injured that he/she himself/herself cannot describe what has happened, much less to contact the emergency service centre. In addition, 45% of all fatal motorcycle accidents are so-called single-vehicle accidents, which may mean that there are no witnesses of the accident. In addition, problems may arise in the communication chain within and between the different involved medical teams, which may result in vital information being misunderstood, misrepresented or omitted.

Within the medical service, there is a great need of information around, among other things, skull injuries in connection with motorcycle accidents. This applies to ambulance personnel as well as nursing staff and physicians in trauma departments and neurosurgical departments. In case of an accident, correct information may be crucial and govern the type of effort to be effected, in all stages of the nursing chain. Based on sensor technology, Umbilical Design AB and Googol Business Navigator AB have developed a system to register, analyze and store information in connection with accidents.

A plurality of systems for measuring violence against the body and automatic calling in case of an accident are previously known.

One such a system is known by the patent document WO2006036567, which discloses a system that, by means of a plurality of (more than one) sensors, monitors physiological parameters (violence) on external parts of the body (the head) of players active in team sports. The system primarily measures linear violence and rotary violence. With sports activities, reference is here made to ice hockey, American football and similar sports where a great amount of violence against the head occurs. The disadvantage, and what separates this system from the present idea, is

- that it is limited to team sports,
- that it monitors physiological parameters of external parts of the body in order to, when a predefined amount of accumulated violence is attained, notify, for instance, a coach who takes the player off the plane to counteract more extensive injury,
- that it does not link registered parameters to body movements, and therefore it cannot be used to recreate a course of events.

Another similar system is known by the patent document U.S. Pat. No. 6,826,509, which discloses a system connected to acceleration sensors that record the size and the direction of an acceleration that arises from an impact against a body part, such as a head, of a person during physical activity such as team sports. The disadvantage, and what separates the system from the present idea, is

- that the system depends on a plurality of sensors,
- that it requires that the sensors are placed with at least one axis perpendicularly to the head,
- that it preferably is designed to alarm when a predetermined amount of accumulated violence against the body has been attained,
- that it preferably is used to register preknown violence against the body, which thereby means normal and expected violence,
- that it is not related to calling about accidents, which applies to abnormal and non-expected violence.

Another such system is known by the patent document JP2001344678, which discloses a system connected to sensors for measuring pulse, blood pressure and oxygen absorption capacity as well as a GPS. The sensors for measuring pulse, blood pressure and oxygen absorption capacity are connected to wrist and ears. The system contains an acceleration sensor that registers abnormal accelerations (e.g. an accident) whereupon it measures pulse, blood pressure and oxygen absorption capacity and sends that information together with time, location and static (preprogrammed) information about the user to a database, which estimates the extent of the accident and what type of effort that should be carried out.

The disadvantage, and what separates the system from the present idea, is

- that it only processes pulse, blood pressure and oxygen absorption capacity relating to the injured person,
- that it does not process violence against specific external parts of the body (the head),
- that it uses the accelerometer only to register that the accident occurs,
- that it not registers course of events over time, and thereby cannot be used to recreate and visualize course of events, and
- that it is limited to send the information by means of a telephone.

Another such system is known by the patent document JP2004310309, which discloses a car-based system, which by means of a sensor registers an accident. Information from the sensor is sent together with static (preprogrammed) data, such as age, gender, blood group, medical history, of the car's owner to an emergency service centre. The extent of the accident is estimated based on the particulars, whereupon an emergency team is sent to the location.

The disadvantage, and what separates the system from the present idea, is

- that it is connected to the car and thereby not registers violence against the body, and
- that it only processes static (preprogrammed) data.

Another such system is known by the patent document JP2005075253, which discloses a car-based system, which by means of an acceleration sensor registers an accident. The system is connected to cameras and microphones. Upon an accident and/or risk of an accident, pictures are taken of the surroundings, sound is recorded and sent together with information about time, location to a service centre. The disadvantage, and what separates the system from the present idea, is

- that it is connected to the car and thereby only indirectly applies to violence against the body,
- that it employs cameras and microphones to collect data,
- that it seems to have, as a primary function, to predict accidents by means of the above-mentioned data collection.

An additional system for the detection of an accident having occurred is known by US 20030197608 A1. The system is arranged to automatically generate alarm by means of an alarm device integrated in a helmet, which helmet is worn by a person. However, this system is not arranged to register how vital data are developing after the accident has occurred.

SUMMARY OF THE INVENTION

An object of the invention is to solve the above-mentioned problems by providing a system for automatic detection and calling for medical effort upon body movements that indicate direct violence against the body that arises in connection with an accident.

An additional object of the invention is to register possible changes of vital data that arise as a consequence of an accident.

According to the invention, the above-mentioned and additional objects are attained by a device according to the features defined in the characterizing clause of claim 1.

Henceforth, an individual's/person's body also relates to the head.

The body movements denominated in the document in connection with an accident relate to the body movements that are unexpected and harmful to the individual and that arise in connection with an accident, for instance fall, collision, turning or impact against the body.

The direct violence denominated in the document relates to the forces, directly directed toward the head or body, that arise in connection with accidents such as crash or fall with a motorcycle. Thereby, the present invention relates to a system that is placed on the head or body, and is not integrated in a vehicle such as the car.

The vital data denominated in the document relates to, e.g., pulse, respiration, blood pressure, oxygen absorption capacity, and EEG.

Accordingly, the invention relates to a system for the detection of body movements that indicate direct violence against a person's/individual's head or body in connection with an accident.

The invention also relates to a device for the registration, storage, processing and transfer of information about direct violence against a body so that the medical effort becomes as quick, good and cost-effective as possible.

The invention further relates to registering, storing, processing and transferring vital data relating to the state of the body in order to provide supplementing information in connection with the accident.

The invention further relates to a system that recreates the course of events in connection with the accident based on registered, stored and processed information, in order to provide as a correct picture of the accident as possible.

The invention also relates to the fact that the stored information about the state of health of the body is stored in an empirical database used for research in, e.g., medical treatment. This type of information may become of great importance when henceforth data from a number of accidents have been analyzed and probability calculi for different types of neck back injuries, acute subdural hematoma, contusions, and diffuse axon injuries can be produced.

The invention also relates to the fact that the information about vital data registered and stored by means of sensors and other registered information, such as position, in the long run should be possible to be used to create utilitarian and entertainment applications and applications for the game industry.

The invention relates particularly to fields of application where a helmet of some type is used, alternatively activities where violence against the body is usually occurring, for instance, during motorcycle-driving, cycling, skiing, riding, skydiving, mountain climbing, car-driving, etc.

Additional features and advantages of the invention are seen in the following detailed description of the invention as well as in the appended drawings and the other claims.

BRIEF DESCRIPTION OF DRAWINGS

The invention is described in more detail below in some preferred embodiments, reference being made to the appended drawings.

DESCRIPTION OF PREFERRED EMBODIMENTS

Figure 1:
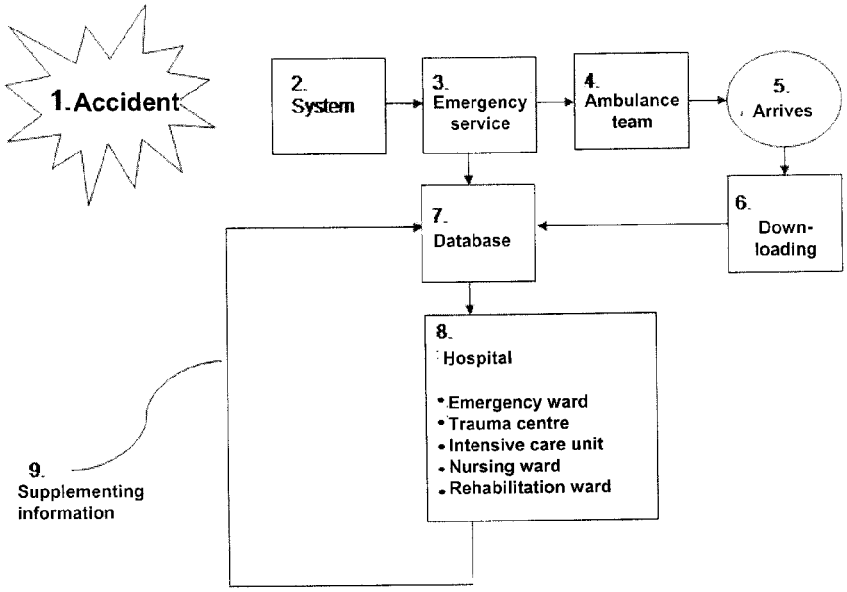
FIG. 1 shows a diagram of the information flow in a system according to the invention.

Sensor technologies may, among other things, be used to measure acceleration, rotation and vital data. Acceleration and rotary violence are significant indicators in skull injuries. Based on the capacity of the sensor technology to register acceleration, rotation and vital data, the present invention has been developed to detect, register, analyze and store information in connection with accidents.

The system according to the invention enables the following:

- Quick alarming about an accident having occurred
- Time and location of the accident
- Correct and objective information about what type of violence the driver has been subjected to in connection with the accident.
- Measurement/registration of the acceleration/deceleration forces that have acted on the head in connection with the accident.
- Measurement/registration of vital data and change over time after the accident.
- Qualitative improvement in emergency care on the scene of the accident and emergency medical effort.
- Correct mediation of precise information through the nursing chain
- Generation of material for storage in a database.

EXAMPLES

A motorcyclist experiences a single-vehicle accident. In the accident, the driver is thrown off the motorcycle and lands on the head. In the landing, the head is subjected to considerable direct violence, which results in the person immediately losing consciousness.

Since the motorcyclist has the present system integrated in the helmet thereof, there are vital data, regarding a determined period of time that precedes the accident, buffered when the accident is registered. Based on the direct violence measured, the system sends a message to the emergency service, or another receiver suitable for the purpose, with information about an accident having occurred, instant of time and position of the accident as well as primary data of the violence the injured person has been subjected to. After the registered accident, the system proceeds to continuously register and store information about vital data.

The receiver, such as the emergency service, initiates an emergency medical effort based on the information and forwards the information to the ambulance team. The information gives the ambulance team a possibility of preparing the medical effort before they arrive to the scene of the accident. When the ambulance team arrives, they have the possibility of downloading complete information about the direct violence the head or the body has been subjected to as well as registered vital data before and after the accident.

Based on the information, the ambulance team has a possibility of recreating the course of events and appreciate how the accident has affected the individual's/person's vital data. This information is stored in the empirical database and can be forwarded so that all levels of the nursing chain get access to the same information.

By the accident course described above, the system has enabled the following:

- Quick alarming about an accident having occurred
- Time and location of the accident
- Correct and objective information about what type of violence the driver has been subjected to in connection with the accident.
- Measurement/registration of the acceleration/deceleration forces that have acted on the head in connection with the accident.
- Measurement/registration of vital data and change over time after the accident.
- Qualitative improvement in emergency care on the scene of the accident and emergency medical effort.
- Correct mediation of precise information through the nursing chain
- Generation of material for storage in a database.

FIG. 1 shows a diagram of the information flow in a system according to the invention.

When a person performing a physical activity that normally comprises a helmet meets with an accident 1, the system 2 registers that an accident has occurred by identifying the degree of violence against the head or body.

Next, the system sends an alarm to a suitable receiver, for instance the emergency service 3. Simultaneously, the system saves information concerning vital data for a specific period of time before the accident as well as starts recording and storing information about the vital data of the body from the occurred accident and onward. Stored information may later be downloaded 6 by, for instance, the ambulance team 4.

When the emergency service receives an alarm about the accident, the alarm contains information about time, location and extent. Thereby, the emergency service has the possibility of judging the degree of effort before it is sent to the location. Next, the emergency service sends the information about the time, location and extent of the accident to a suitable emergency patrol, for instance an ambulance team 4.

When the ambulance team arrives to the scene of the accident 5, they have the possibility of downloading complete information about the course and extent 6 of the accident to PDA (Personal Digital Assistant) or another system for handling data. The ambulance team may also download information about vital data that the system has stored before and after the accident by means of continuous measuring of, for instance, pulse, respiration, blood pressure, oxygen absorption capacity, and EEG.

By the information provided, the ambulance team has thereby the possibility of creating a picture—visual as well as computer-based—of the course of events that was initiated a fixed time before the accident and is terminated when the ambulance team arrives to the location.

Information provided can thereby replace today's estimated information that the ambulance team guesses, in the event that the injured person is unconscious and thereby unable to communicate the course of events by himself/herself.

By means of the information provided, the ambulance team can become better prepared for the state of the injured person and plan specific efforts to limit the consequences of the accident for the injured person.

The downloaded information is then transferred to the empirical database 7, to supplement the information previously input by the emergency service. The database allows all levels 8 of the nursing chain to get access to the same information, for instance, the emergency ward, the trauma centre, the intensive care unit, the nursing ward and the rehabilitation ward.

The contents of the database may be supplemented by the different levels of the nursing chain 8.

It should furthermore be possible to use the database as a basis of research.

Figure 2:
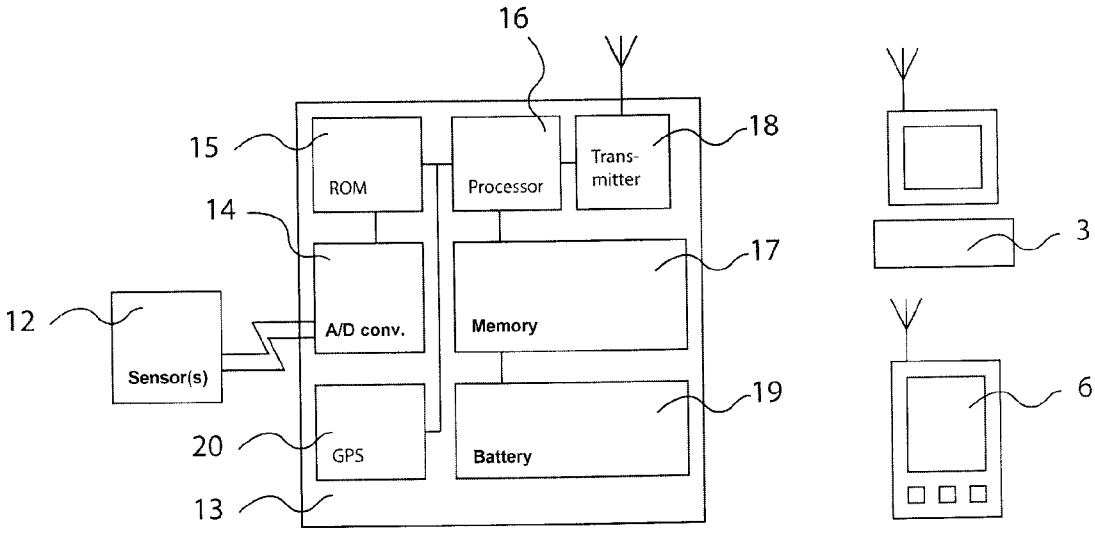
FIG. 2 shows a component scheme of a system according to the invention.

FIG. 2 shows a component scheme of a system according to the invention.

On one hand, the system consists of one or more sensors 12, which register movement that distinguishes an accident as well as how vital data are affected over time in connection with an accident and after the same, the sensor or the sensors being primarily placed on the head but may also be placed externally on other parts of the body relevant for the purpose.

The above-mentioned sensor or sensors are uniaxial or multiaxial acceleration sensors as well as sensors for measuring e.g., pulse, respiration, blood pressure, oxygen absorption capacity, and EEG.

On the other hand, the system consists of a unit 13, the purpose of which is to receive information from the sensors, process and store the information, transmit a signal to the emergency service 3, and also provide information to the ambulance team 4 that arrives to the scene of the accident.

The above-mentioned unit contains a component to translate the analog signals arriving the sensors, for instance an A/D converter 14. The unit contains a component to receive and filter the digital signals generated, for instance a Read Only Memory 15. The unit also contains a processor, 16, which, by means of an algorithm, analyzes the values that have been filtered. The unit contains furthermore a writeable memory 17, for storage of the information that is generated in connection with the accident, for instance a flash memory. The unit contains furthermore a transmitter 18 that transmits a signal to the emergency service 3, or another receiver suitable for the purpose, as well as supplementing information to the ambulance team 4 arriving 5. The unit contains furthermore a source of power, for instance a battery 19. The unit contains furthermore a positioning system, for instance a GPS 20.

Figure 3:
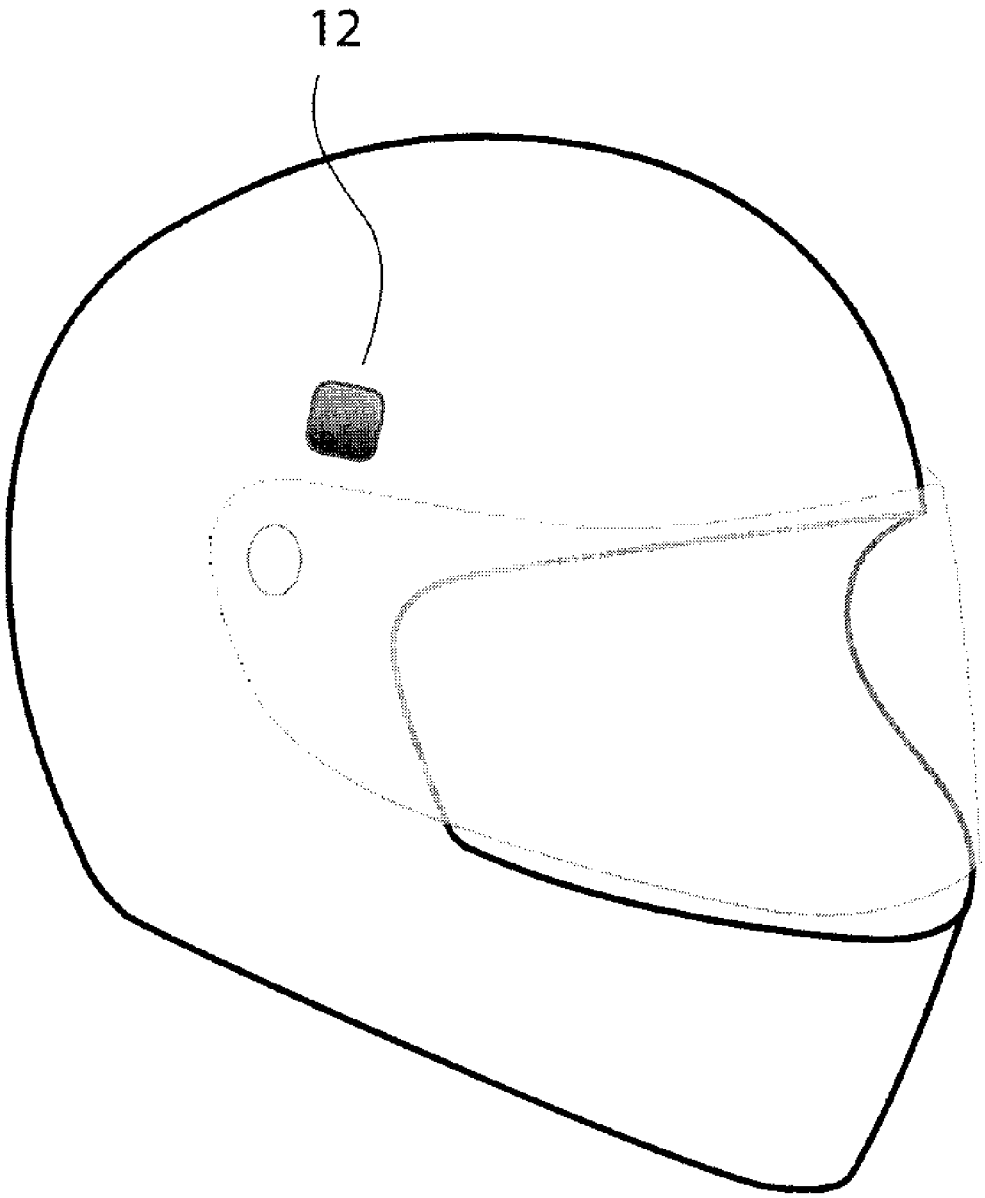
FIG. 3 shows a perspective view of a motorcycle helmet including an applied sensor.

FIG. 3 shows a perspective view of a motorcycle helmet including an applied sensor.

The invention is primarily intended to be used by persons in activities where a helmet of some type is a natural element.

Examples of such activities are motoring, motorcycle-driving, skiing, riding, skydiving, mountain climbing and cycling.

In addition to the above-mentioned users, the system may also be used in surrounding activities where it for other reasons is of interest to transmit an alarm signal after abnormal body movements, such as in connection with avalanches, car-driving, activities for the aged, etc.

The system is primarily intended to exist in two variants. A first variant is based on sensors integrated in the helmet when purchasing the helmet in a shop. In this variant, in addition there is the unit that receives information from the sensors, processes and stores the information, sends a signal to the emergency service and also provides information to the ambulance team that arrives to the scene of the accident.

A second variant is a retrofit solution where the sensors are fitted to an already purchased helmet. Also to this variant, in addition there is the unit that receives information from the sensors, processes and stores the information, sends a signal to the emergency service and also provides information to the ambulance team that arrives to the scene of the accident.

The system may also be in the form of units that are connected to mobile telephones, other communicating units, a GPS, or other body-worn objects that can act as a platform for the invention.

The system may furthermore be based on sensors placed on other parts of the body than the head, or in other head-worn objects than a helmet.

The invention has been described above with reference to a plurality of different preferred embodiments. Naturally, the invention is not limited to the same, but also other variants of the invention are feasible within the scope of the extent of protection of the subsequent claims.

Thus, it is also feasible that sensors and electronics for registering, storing, processing and transferring are placed in a mobile telephone and that the transfer to a central alarm unit takes place via said mobile telephone. By means of a more developed technique, substantial parts may even be housed in a key-ring.

The invention claimed is:

1. A system integrated in a helmet or another headgear, for the registration of direct violence against the head/body that a wearer of the helmet is subjected to in connection with an accident, comprising at least one sensor intended to detect movements, at least one sensor for measuring vital data, a unit arranged to register and receive data from said at least one sensor intended to detect movements and said at least one sensor for measuring vital data and calculate at least one parameter of the head movement, based on said calculations, the unit being arranged to identify when an accident has occurred and to store data a certain time before the accident and stop storing a certain time after the accident as well as to generate an alarm and transmit information related to the accident to a receiver, wherein the system is arranged to recreate the course of events based on registered, stored and processed data in order to provide as correct a picture of the accident as possible, and to monitor how vital data are developing after the accident so that the ill-fated thereby should get as quick and correct care as possible.

2. System according to claim 1, wherein the system in addition is arranged to link the direct violence against the head with the development of vital data after an accident in order to generate information to be used for adaptation of the medical effort to the accident in question.

3. System according to claim 1, wherein a GPS unit is arranged for position finding.

4. System according to claim 1, wherein the system is arranged to transmit information to an emergency service or another receiver.

5. System according to claim 1, wherein a wireless unit is arranged to communicate via GSM, Wimax, WiFi, 3G, 4G or Satellite.

6. System according to claim 1, wherein stored data can be transferred to another unit by staff on the scene of the accident.

7. System according to claim 1, wherein data regarding the accident can be stored in a database in order to be made available to an emergency ward, medical treatment, after-care or other suitable levels.

* * * * *